United States Patent [19]

Davlantes

[11] 4,047,331

[45] Sept. 13, 1977

[54] PET ACCESS DOOR PANEL

[76] Inventor: George N. Davlantes, 7844 Gazette Ave., Canoga Park, Calif. 91306

[21] Appl. No.: 622,067

[22] Filed: Oct. 14, 1975

[51] Int. Cl.[2] ..... E06B 7/28

[52] U.S. Cl. ..... 49/171; 160/90; 160/DIG. 8

[58] Field of Search ..... 49/168, 169, 170, 171, 49/466, 67, 413, 380, 501; 160/372, 374, 90, 91, 368, 222, 202, DIG. 8, 225; 52/585

[56] References Cited

U.S. PATENT DOCUMENTS

| | | | |
|---|---|---|---|
| 1,540,129 | 6/1925 | Houston | 160/225 |
| 2,758,646 | 8/1956 | Johnson | 160/DIG. 8 |
| 3,293,813 | 12/1966 | Emmons et al. | 52/585 |
| 3,797,554 | 3/1974 | Johnson | 160/DIG. 8 |
| 3,878,645 | 4/1975 | Porter | 49/169 |

*Primary Examiner*—Peter M. Caun

[57] ABSTRACT

A panel for securing in a conventional sliding door opening to cooperate with the sliding doors therein has a swinging door flap at the bottom of a panel defined by vertical stiles which may be trimmed to suit varying door frame heights. The stiles bear fixed projections to fit horizontal apertures at the door stile and sliding projections to fit apertures in sill and top rail of the frame. The panel has an adjustable rail which overlaps the weather pane of the panel at top or bottom of the pane. The access door flaps swings from an intermediate rail which may be a part of a panel or a part of a sub-assembly mountable in any opening. The flap has imbedded magnets to arrest it closed and thin wiper edges to seal against weather, and is self-hinging in the intermediate rail.

1 Claim, 11 Drawing Figures

PET ACCESS DOOR PANEL

BACKGROUND OF THE INVENTION

The invention relates to access doors into and out of dwellings for pets, and more particularly to access door panels for placement in existing sliding door frames, wherein the doors are usually of glass and framed in aluminum. Several patents have been issued to inventors seeking solutions to the problems attendant to such access door panels, among them:

U.S. Pat. No. 3,464,158 Greene issued Sept. 2, 1969

3,654,733 Blackwell issued Apr. 11, 1972

Conventionally access doors for pets have been equipped with swinging flaps, usually top-hinged so as to be operable easily by the pet, such as a dog or a cat. Some access doors have been placed in the sides of buildings, while others have been placed in upright panels mountable at one side of the framed opening for sliding glass doors, such as those giving egress to patios and porches. In the case of the latter installation, the large variety of door heights has been a great problem, often thwarting economical installation due to the time taken in modifying the pet access door panel to fit the frame of the door opening. Locking of the added panel to preclude unauthorized entry has been another problem, as has been adequate sealing of the area around the swinging door flap. The present invention affords a height-adjustable pet access door panel which is easy to install, positively fixed in place in cooperation with the existing sliding doors, and effectively sealed against weather when in use.

BRIEF SUMMARY OF THE INVENTION

The invention contemplates, in an opening with a frame having horizontal and vertical apertures and sliding doors in the frame, a pet access door panel which comprises a pair of spaced vertical stiles holding a weather pane, and top, intermediate and bottom rails extending between stiles. The rails define the access door panel and the access door itself. Either the top rail or the intermediate rail overlapp the weather pane and is adjustable vertically with respect to the pane and the stiles. The overlapping rail is skirted to cover more or less of the adjacent pane and to make a sliding seal therewith.

Preferably the intermediate rail has inwardly facing channels which receive outer beads of the access door flap and define a hinge joint therewith. The vertical edges of the access door may have grooved members adapted to receive a sliding plate which is thereby fixed over the door flap to preclude its use. Preplaced apertures in the existing frame receive horizontal rods fixed to one stile. Similar apertures in the sill and top rail of the frame receive slidable locks secured to the opposite stile. Means are provided for latching the sliding door in part displaced by the access door panel to the access door panel.

In a preferred embodiment of the invention the vertical edges of the door flap have resilient wipers which contact the grooved members at each edge of the access doorway and compress against the members for a windproof seal. Magnets in the flap and in the doorway bottom rail may cooperate to arrest the flap in closed position after the flap has been displaced by a pet.

In installing the pet access door panel it is only necessary to adjust the movable rail for height of the door and then trim the stiles at either top or bottom for a perfect vertical fit. These and other advantages of the invention are apparent from the following detailed description and the drawing.

BRIEF DESCRIPTION OF THE DRAWING

In the various Figures like parts are identified by like reference characters.

DESCRIPTION OF THE PREFERRED EMBODIMENTS

Figures 1, 2, 3, 4, 5:
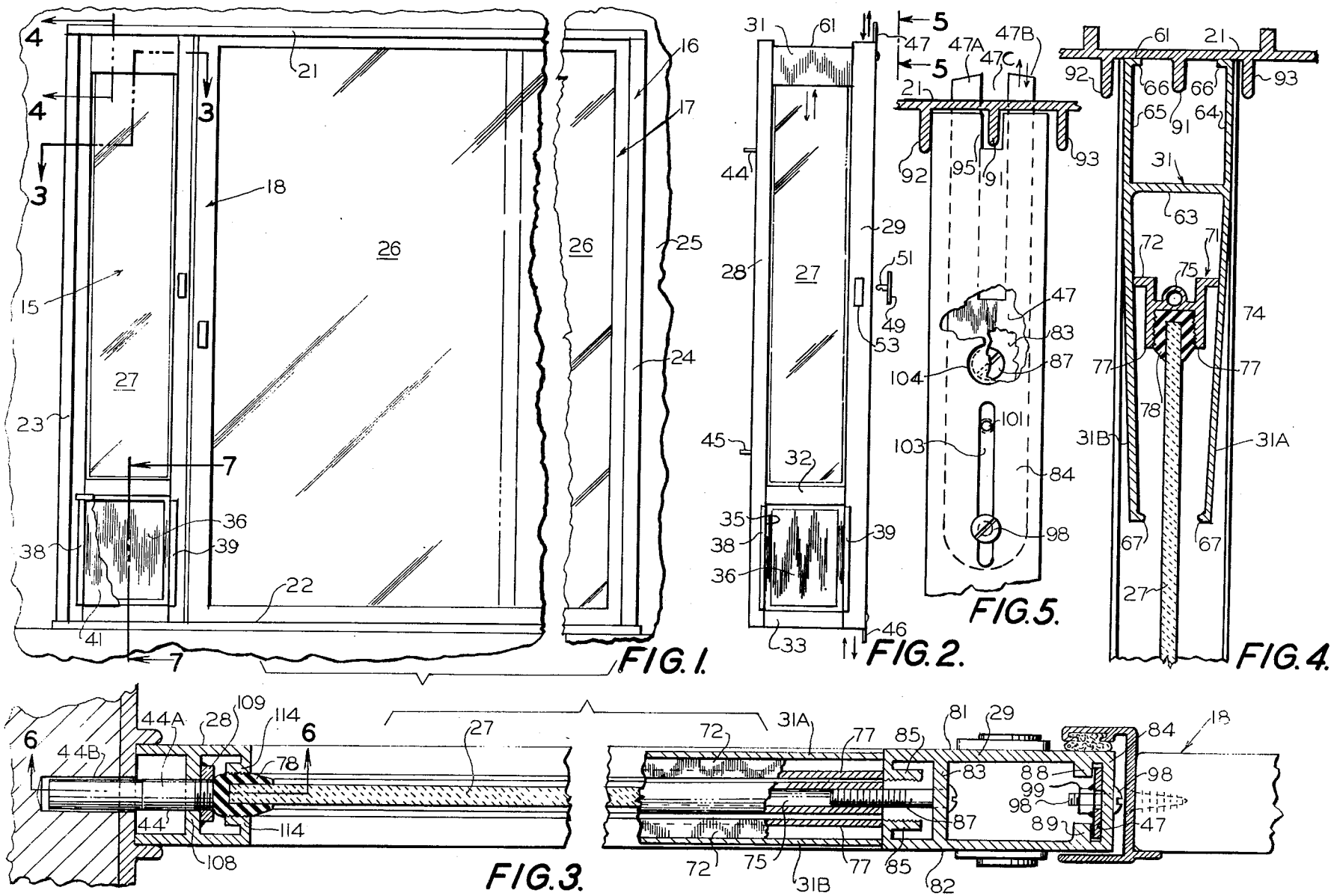
FIG. 1. is an elevational view, partly broken away, of the access door panel of the invention in place in a framed doorway.
FIG. 2 is an elevational view of the access door panel alone.
FIG. 3 is a fragmentary plan section taken along line 3 — 3 of FIG. 1.
FIG. 4 is a fragmentary sectional elevation taken along line 4 — 4 of FIG. 1.
FIG. 5 is a fragmentary end elevation taken along line 5 — 5 of FIG. 2 and partly broken away.

In FIGS. 1 - 9 a pet access door indicated generally at 15 resides within a door frame 16 having an outer sliding door 17 and an inner sliding door 18. The access door panel abuts the inner door 18. The frame has an upper frame rail 21 and a sill 22 as well as stiles 23 and 24, set in the structure wall 25. Each door has a conventional weather panel 26 of glass. The pet access door panel has a weather pane of glass 27.

As can be seen from FIG. 2, the weather pane is fixed between two vertical stiles 28, 29 and horizontal top panel and intermediate panel rails 31, 32 respectively. A bottom rail 33 and the intermediate rails combine with portions of the stiles to define a pet access doorway 35. A swinging door flap 36 closes doorway 35, spanning between opposed inner faces of opposed grooved members 38 and 39 in a manner to be described later. A closure insert 41 fits into the channels of grooved members 38, 39 to block the access doorway 35 as desired.

Pet access door panel 15 is secured within frame 16 by means of spaced horizontal rods 44, 45 projecting from stile 28 and by vertically slidable latches 46, 47 movable with respect to stile 29 at the top and bottom thereof. A latch plate 49 with a tongue 51 is shown detached from sliding door 18, being concealed from view in FIG. 1. A latch handle 53 on the access door panel affords means for latching the door with respect to the secured door panel.

Grooved members 38 and 39 project on both inner and outer faces of the access door panel and the closure insert may be applied at either face. Latch member 53 is installed at both sides of the stile 29 so that the access door panel of the invention may be installed at either end of a doorway such as the doorway 16 without regard for right hand or left hand orientation.

Because of the adaptability to either right or left handed installation, which means that the one face of the pet access door panel may be either interior or exterior, it is preferred that a barrel lock (not shown) be used in combination with the conventional latch handle to deny unauthorized entry to those without a key.

As previously mentioned, one of the difficulties in installing pet access door panels is the great variety of vertical dimensions of the conventional door frames. In addition there are minor variations in the track dimensions transversely of the sills and the top plates of the door frames in which the glass doors slide. As indicated in FIG. 2, the access door panel of the invention includes an adjustable top panel rail 31. The top rail is adjustable both with respect to the vertical stiles of the panel and with respect to the weather pane 27. The top rail of the invention is unique in its configuration and in its ability to adapt the panel to all door frame heights.

As can be seen from FIG. 2, the rail 31 has been adjusted so that its top edge 61 is below the tops of the stiles 28, 29. The top 61 has been adjusted to fit the height of the door frame 16. It is thus only necessary to trim the tops of the stiles 28, 29 to coincide with the edge 61 of the rail to have the entire access panel suited to the heighth of the door frame for the sliding glass doors. As can be seen from FIGS. 3 and 4 top rail 31 is unique in design and in function. In the cross section of FIG. 4 the rail is symmetrical and has a transverse stiffener 63 extending between side walls 64, 65. Each side wall has a lip 66 which together define the upper edge 61 of the rail. Beneath the stiffener the walls extend in opposed shroud plates 31A, 31B each of which terminates in inwardly projecting lips 67. THe shroud plates converge downwardly and are preferably made of resilient material such as aluminum so that a sealing element 71 fixed to the top of the pane can be accommodated whatever its vertical position between the shroud plates. The sealing element comprises an extruded H shape with upper fingers 72 which contact the inner surfaces of the shroud plates. The central bar 74 of the sealing element is combined with a hollow, horizontal semi-cylinder 75 which is used to secure the top rail with respect to the weather pane. The lower limbs 77 of the element are spaced apart and serrated on their inner faces to receive the conventional resilient sealing strip 78 for the weather pane 27.

As can be seen from FIG. 4 an effective seal against air transfer between interior and exterior around the top of the weather pane is established by the sealing element 71 and its contact with the shroud plates 31A, 31B of the top rail. As previously noted, the stiles 28, 29 are fixed to the top rail by means of the hollow semi-cylinder 75 of the sealing element 71. This is also apparent from FIG. 3 in which the stile 29, which is preferably an extruded aluminum strip having inner and outer faces 81, 82, respectively, between which continuous webs 83 and 84 extend, also has glass receiving limbs 85 which extend the length of the stile. A self-tapping screw, such as the screw 87, extends through web 83 and is threadably engaged within the interior of the semi-cylinder 75, to fix the sealing element with respect to the stile. Since the sealing element and the top rail are of equal widths the stiles are also thereby compressed against the sides of the top rail and secure the top rail in the desired position by the compressive force.

Stile 29 also has a pair of opposed beads 88, 89 which extend the vertical length of the stile within outer web 84. The web and the beads restrain the slidable latches 46, 47, latch 47 being visible in FIG. 3. Each latch has spaced prongs 47A, 47B, extending outwardly from the stile, as seen in FIG. 5, the prongs defining an aperture 47C to fit about a central flange 91 of the top rail of the door frame 16. Other conventional flanges 92, 93 on either side of the access door panel serve as guides for the sliding doors 17, 18 of the frame. Flange 91 is not always present in an existing frame, and the accommodating notch 95 in the stiles is therefore only needed when a central flange is encountered on the top rail of the door frame. In most instances the pet access door panel is registered against the inner flange 92 which then serves as an index for making the apertures for the rods and sliding latches.

There are great variations in the types of top rails and bottom sills because of the diversity of manufacturers, but most are easily accommodated by the inventive apparatus. The prongs 47A, 47B fit into the previously prepared apertures in the frame rail and sill, and into the wooden surround for the frame and secure the access door panel at stile 29 firmly in the door frame. Preferably the latches 46, 47 are secured in place by a threaded member 98 which engages a nut 99 fixed to the inner face of a latch. Alternate embodiments may incorporate threaded holes in the latch body itself.

Again, in FIG. 5 a second tapped aperture 101 on the latch 47 is spaced upwardly from the nut 99 to provide for differing positions of the latch when the stiles are trimmed for various height frames. An elongate slot 103 in the web 84 further provides for latch adjustment with respect to the end of the stiles.

Access to the locking screw 87 is achieved through an aperture 104 in web 84 prior to insertion of the latches 46, 47 into place in the stile 29. As previously noted, in addition to the vertically reciprocable latches 46, 47, horizontal rods 44, 45, extending from stile 28 serve to secure the access door panel against removal. Both the latches and the rods are inaccessible when the sliding door is locked to the access door panel.

Figure 6:
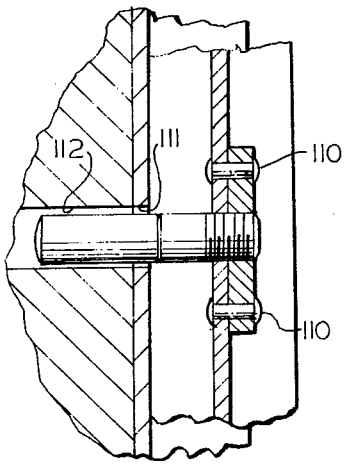
FIG. 6 is a fragmentary sectional elevation taken along line 6 — 6 of FIG. 3.

In FIG. 3 the rod 44 is seen to be a jointed rod having portions 44A and 44B which may be similar to the jointed binding posts common to accounting ledgers. The length of the rods is thus adjustable to suit various installation requirements. Each rod 44 is secured to the central web 108 of the stile 28 by a threaded retainer 109 fixed to the web as by rivets 110, as shown in FIG. 6. Each rod extends through a drilled hole 111 in the door frame member 23 and may further extend into drilled hole 112 in the door framing lumber 113.

Figure 7:
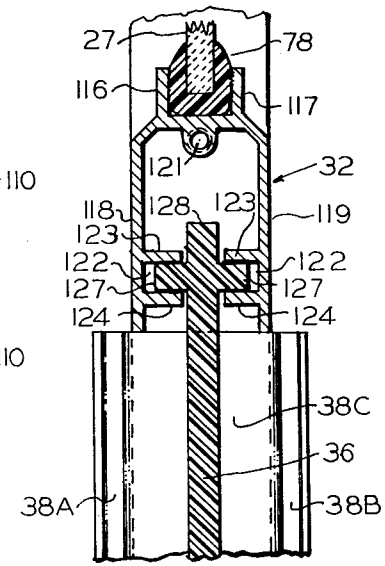
FIG. 7 is a fragmentary sectional elevation taken along line 7 — 7 of FIG. 1.
Figure 7:
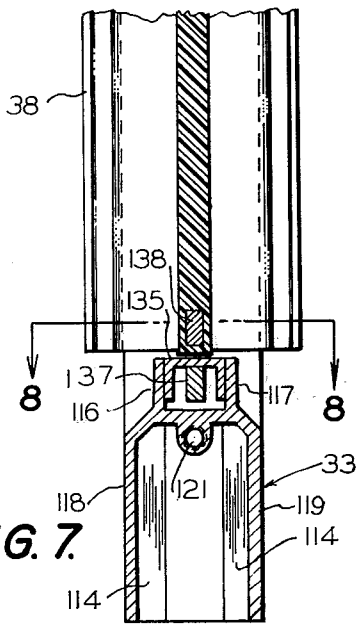

It can be appreciated that the access door panel is first inserted into the same track as the inner door occupies, and then moved horizontally along the track until the rods seat in the apertures 111. Then the latches 46, 47 are set in similar apertures in the rail and sill. Like stile 29, stile 28 has spaced limbs 114 serrated on their facing surfaces to securely grip the resilient glass retainers 78 for the weather pane 27. As can be seen in FIG. 7, the bottom edge of the weather pane is similarly gripped by a resilient grip 78 which lodges in a channel of the intermediate panel rail 32. The channel is defined by parallel upstanding strips 116, 117 on the upper portion of the intermediate rail. The rail is further defined by parallel spaced plates 118, 119 which extend horizontally the width of the rail. A hollow semi-cylinder 121 similar in configuration and function to the semi-cylinder 75 of the sealing element 71 also extends the width of the rail and, in the manner previously described, receives a self-tapping fastener such as the fastener 87 to secure stiles 28 and 29 to the intermediate rail.

Near the lower edge of the intermediate rail each horizontal plate has a channel 122 defined by spaced parallel strips 123, 124. A swinging semi-flexible door flap 36 is secured in the channel by means of oppositely protruding ridges 127 near the top 128 of the flap. The door flap is assembled with the intermediate rail prior to assembly of the rail with one or both stiles 28, 29. The ridges are slipped into the channels to suspend the door flap for swinging motion within the doorway 35.

Figure 8:
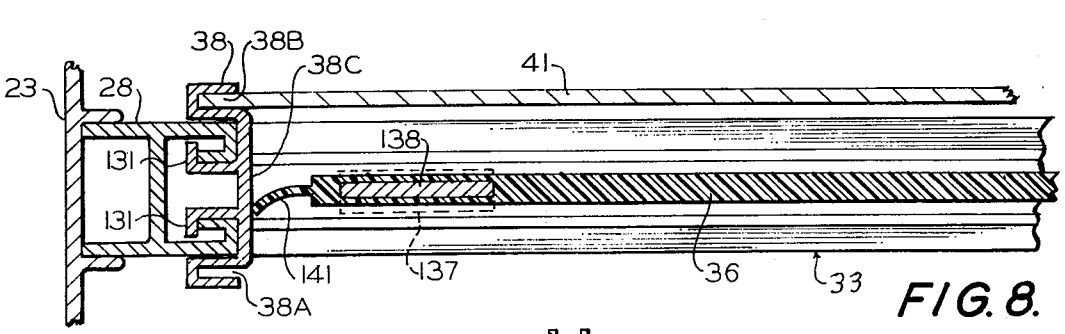
FIG. 8 is a fragmentary plan section taken along line 8— 8 of FIG. 7.

FIG. 7 also shows the compound nature of grooved members 38 and 39, member 38 being specifically illustrated, in cross section in FIG. 8. The grooved member 38 has channels or grooves 38A and 38B on opposite vertical edges of a central web 38C. Removable closure insert 41 is shown in place in the fragmentary view of FIG. 8. In view of the fact that each grooved member has channels on both faces of the access door panel, it is obvious that the closure insert may be placed inside or outside the panel.

Each grooved member has projecting outwardly from the central web continous fingers 131 which fit between and within the limbs 114 of stile 28 and limbs 85 of stile 29, for members 38 and 39, respectively. The grooved members are held in place between the intermediate rail and the bottom rail. Bottom rail 33 is substantially identical to rail 32, having upper strips 116 and 117 with side plates 118, 119, but lacking the channel defining strips 123, 124. However, in the interest of simplifying inventory and die costs, the bottom rail may be the same as the intermediate rail, with the channel strips 123, 124 being nullities in the bottom rail. The hollow semi-cylinder 121 of the bottom rail receives a self-threading fastener 87 in the manner previously described to clamp the bottom rail between the stiles. Once the magnet retainer 135 has been placed between the strips 116, 117 the stiles may be clamped. The retainer holds holds a pair of horizontally spaced magnets like the magnet 137 shown in broken lines in FIG. 8 which cooperates with a second spaced magnet pair like the embedded magnet 138 at the end of the swinging door flap 36 to arrest the door flap when it reaches a vertical attitude within the confines of the grooved members 38, 39. The door flap is thus centrally secured adjacent the upper surface of the magnet retainer 135 and can thereby be an effective seal against air transfer.

In order to effect an acceptable side seal the door flap has a vertical side wiper 141 on each vertical edge which compress on contact with the central web 38C and commensurate web 39C as the door flap passes through the door opening 35.

Figure 9:
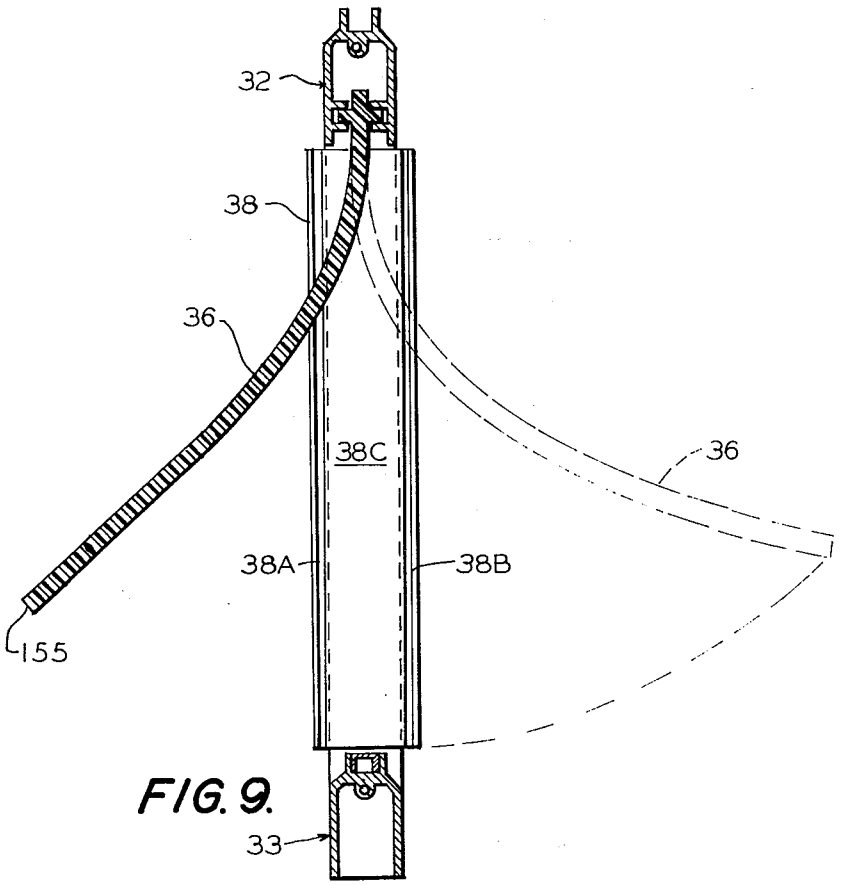
FIG. 9 is a fragmentary sectional elevation taken along line 9 — 9 of FIG. 7.

It can be seen from the foregoing description that the described embodiment provides a pet access door panel which is adjustable to match various height doorways, is easily fabricated from extruded materials, is secure when in place and provides effective seals against air transfer between interior and exterior areas. As shown in FIG. 9, the door flap swings either way, but is arrested in closed position after each use as shown in FIG. 7.

Figure 10:
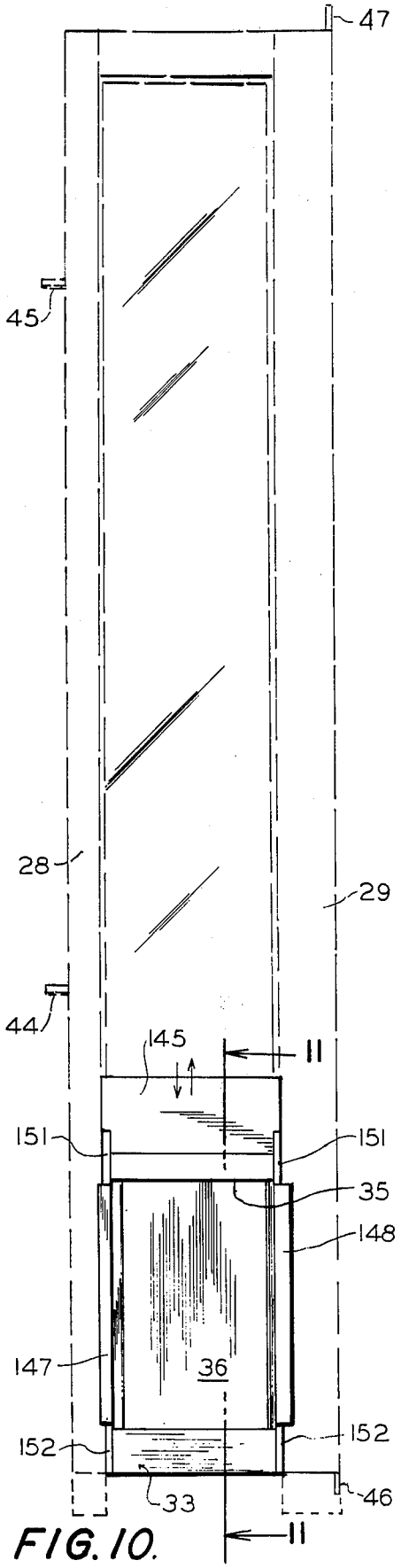
FIG. 10 is an elevational view of an alternate embodiment of the invention with the intermediate rail as adjustable.
Figure 11:
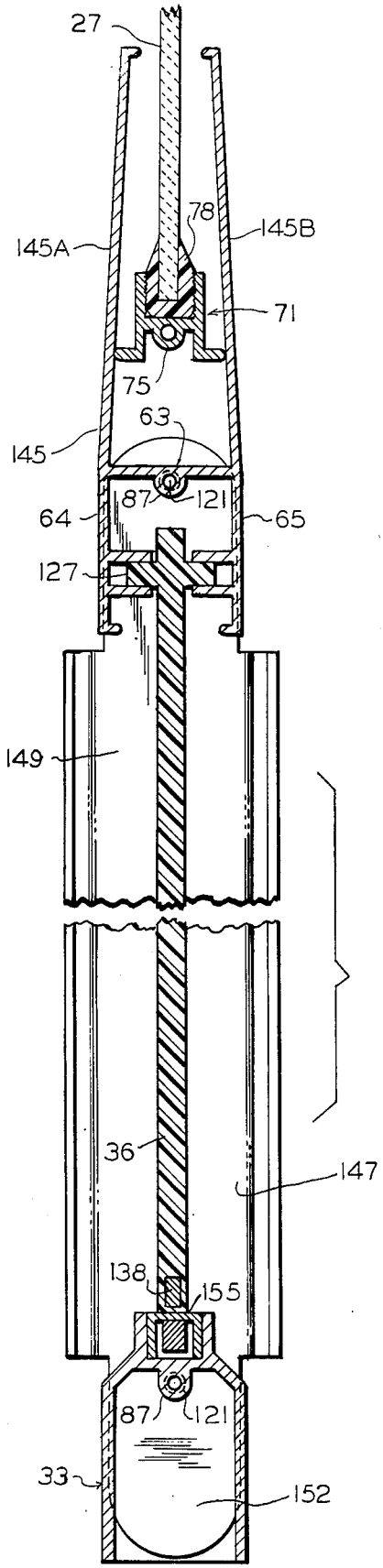
FIG. 11 is a fragmentary sectional elevation taken along line 11 — 11 of FIG. 10.

The embodiment of FIGS. 10 and 11 has similar advantages and serves similar functions, but serves as a pet access door in panels or in walls. The intermediate panel is integral with the bottom rail such that the space between the pair of rails is constant so that both may be adjusted vertically with respect to the stiles and the weather pane without changing the vertical height of the access door.

An intermediate rail similar to top rail 31 is inverted. The intermediate rail 145 has a transverse stiffener 63 from which side walls 64, 65 depend. The walls extend upwardly in shroud plates 145A, 145B which contact a sealing element 71 similar to that which was described with respect to the embodiment of FIG. 1. A weather pane 27 is secured in the sealing element by resilient seal 78. A semi-cylinder 75 extends the width of the rail and the sealing element.

A bottom rail 33 defines the bottom of an access doorway 35 with the intermediate rail and grooved members 147, 148. Each member has inner and outer grooves or channels outside the doorway in vertical alignment with a central web 149. The end of each web extends beyond the grooves in a joinder portion 151 at the top and a joinder portion 152 at the bottom. Self-threading fasteners 87 extend through the portions 151 and 152 into the semi-cylinders of the intermediate and bottom rails to fix the grooved members and the rails together. Obviously closure inserts like insert 41 may be placed in the member grooves to block the doorway 35.

The side walls 64, 65 of intermediate rail 145 have inwardly opening channels defined by horizontal strips 123, 124. A semi-flexible door flap as wide as the doorway has protruding ridges 127 near its top 128. The ridges abide in the channels and afford a hinge mount for the door flap to swing from so the flap may be thrust either way in the doorway. As in the previously described embodiment, the flap and the bottom rail may both have cooperating magnets to arrest the flap so that its bottom edge 155 is in contact with the upper surface of the bottom rail for a weather seal.

As shown in FIGS. 10 and 11, the pet access door has stiles 28 and 29 which may extend upwardly to a top panel rail (not shown). The illustrated access door is thus an access door panel for close use with sliding doors in a frame, catches 157 securing to the stiles.

The invention does not preclude the use of the unitary subassembly comprised of the rails and grooved members and the door flap in openings other than for sliding doors. This and other modifications of the invention within the scope thereof will occur to those skilled in this art. It is therefore desired that the invention be measured by the appended claims rather than by the illustrative disclosure set forth herein.

I claim:

1. A pet access door panel for insertion in an opening with a frame having horizontal and vertical apertures in said frame and cooperating with sliding doors in said frame opening, and comprising spaced vertical stiles;

a weather pane restrained between the stiles;

an intermediate access door rail;

a bottom access door rail;

a top panel rail, each rail extending between the panel stiles;

an access door flap for a pet;

means swingably securing the access door flap to the intermediate rail;

means releasably securing the access door flap to the bottom door rail;

means for adjusting the height of the access door panel;

vertically extending means and vertically spaced horizontal rods fixed in a said stile to protrude therefrom into the horizontal apertures in the said frame for fixing the access door panel in the framed opening;

said access door flap including lower door edge means moveable to door opening positions on opposite sides of said bottom access door rail;

said means releasably securing said access door flap comprising generally vertically superposed yieldable, magnetic securing means carried by said lower door edge means of said access door flap and an upper edge portion of said bottom access door rail;

said generally vertically superposed yieldable securing means cooperating to exert generally vertically oriented access door flap centering force, tending to yieldably position said lower door edge means of said access door flap superposed along said upper edge portion of said bottom access door rail; and said access door flap including laterally projecting wiper means operable to compressively engage said spaced, vertical stiles, said laterally projecting wiper means comprising reduced thickness wed portions of said access door flap.

* * * * *